US005447462A

United States Patent [19]

Smith et al.

[11] Patent Number: 5,447,462

[45] Date of Patent: Sep. 5, 1995

[54] FABRIC LAMINATE AND GARMENTS INCORPORATING SAME

[75] Inventors: Eugene A. Smith, Sharpsburg, Ga.; Anthony J. Tedeschi, Ridgewood, N.J.

[73] Assignee: Playtex Apparel, Inc., Stamford, Conn.

[21] Appl. No.: 58,696

[22] Filed: Apr. 13, 1993

[51] Int. Cl.[6] ..... A41C 1/08

[52] U.S. Cl. ..... 450/122; 450/123; 450/124; 450/156; 450/39; 450/40; 450/93; 2/73; 428/247; 428/253

[58] Field of Search ..... 2/73, 400, 401, 402, 2/406, 409, 243.1; 450/8, 19, 14, 20, 21, 39, 75, 40, 76, 92, 93, 97, 114, 115, 116, 117, 132, 124, 122, 123, 125, 126, 127, 128, 129, 130, 131, 132, 155, 156; 428/253, 247, 284, 109, 402

[56] References Cited

U.S. PATENT DOCUMENTS

| | | | |
|---|---|---|---|
| 2,004,110 | 6/1935 | Head . | |
| 2,021,352 | 11/1935 | Eustis . | |
| 2,165,099 | 7/1939 | Hansen . | |
| 2,183,380 | 12/1939 | Hurt . | |
| 2,184,153 | 12/1939 | Schwartz . | |
| 2,312,200 | 2/1943 | Teague et al. . | |
| 2,418,242 | 4/1947 | Williams | 450/132 |
| 2,817,597 | 12/1957 | Alderfer . | |
| 2,915,067 | 12/1959 | Bracht . | |
| 2,981,257 | 4/1961 | Kress | 450/8 |
| 3,002,849 | 10/1961 | Harmon et al. . | |
| 3,021,844 | 2/1962 | Flagg et al. . | |
| 3,021,845 | 2/1962 | Smith | 450/39 |
| 3,146,779 | 9/1964 | Flagg | 450/39 |
| 3,225,768 | 12/1965 | Galitzki et al. . | |
| 3,228,401 | 1/1966 | Byrne . | |
| 3,317,645 | 5/1967 | Nirenberg . | |
| 3,320,346 | 5/1967 | Galitzki et al. . | |
| 3,327,707 | 6/1967 | Storti . | |
| 3,383,263 | 5/1968 | Storti . | |
| 3,489,154 | 1/1970 | Kaspar et al. . | |
| 3,497,415 | 2/1970 | Adachi . | |
| 3,606,891 | 9/1971 | Marcario et al. | 450/21 X |
| 3,676,269 | 7/1972 | Schaetti . | |
| 3,682,738 | 8/1972 | Smith . | |
| 3,750,673 | 8/1973 | Panrock . | |
| 4,097,629 | 6/1978 | Schneider . | |
| 4,135,025 | 1/1979 | Backes . | |
| 4,139,613 | 2/1979 | Hefele . | |
| 4,148,322 | 4/1979 | Jacaruso et al. . | |
| 4,172,002 | 10/1979 | Gluckin . | |
| 4,372,321 | 2/1983 | Robinson . | |
| 4,375,445 | 3/1983 | Cole et al. . | |
| 4,419,997 | 12/1983 | Cole et al. . | |
| 4,557,267 | 12/1985 | Cole . | |
| 4,701,964 | 10/1987 | Bell et al. . | |
| 4,720,415 | 1/1988 | Wienen et al. . | |
| 4,776,916 | 10/1988 | Prunesti et al. . | |
| 4,956,878 | 9/1990 | Boynton | 2/67 |
| 5,234,523 | 8/1993 | Battreall | 156/283 |

*Primary Examiner*—Jeanette E. Chapman

*Attorney, Agent, or Firm*—Abelman, Frayne & Schwab

[57] ABSTRACT

A fabric laminate is disclosed which is formed of stretch fabrics laminated together by an integrally formed adhesive web having differential stretch characteristics. One or both of the stretch fabrics may include elastomeric yarn. The adhesive web is placed within the laminate with its primary elongation direction being in a predetermined direction, in conjunction with the orientation of the primary elongation directions of the fabrics, such that the resultant elongation characteristics of the laminate is combinedly determined by the fabrics and the web as well as the predetermined orientation of their primary elongation directions. The laminate may be used for forming the control panel of women's undergarments, such as the stomach, thigh or rear control support of a panty, or the undercup or side support of a brassiere. The adhesive web which unites the two fabrics forming the laminate is a open net-like film of heat sensitive adhesive which may be formed of a polyamide material.

42 Claims, 6 Drawing Sheets

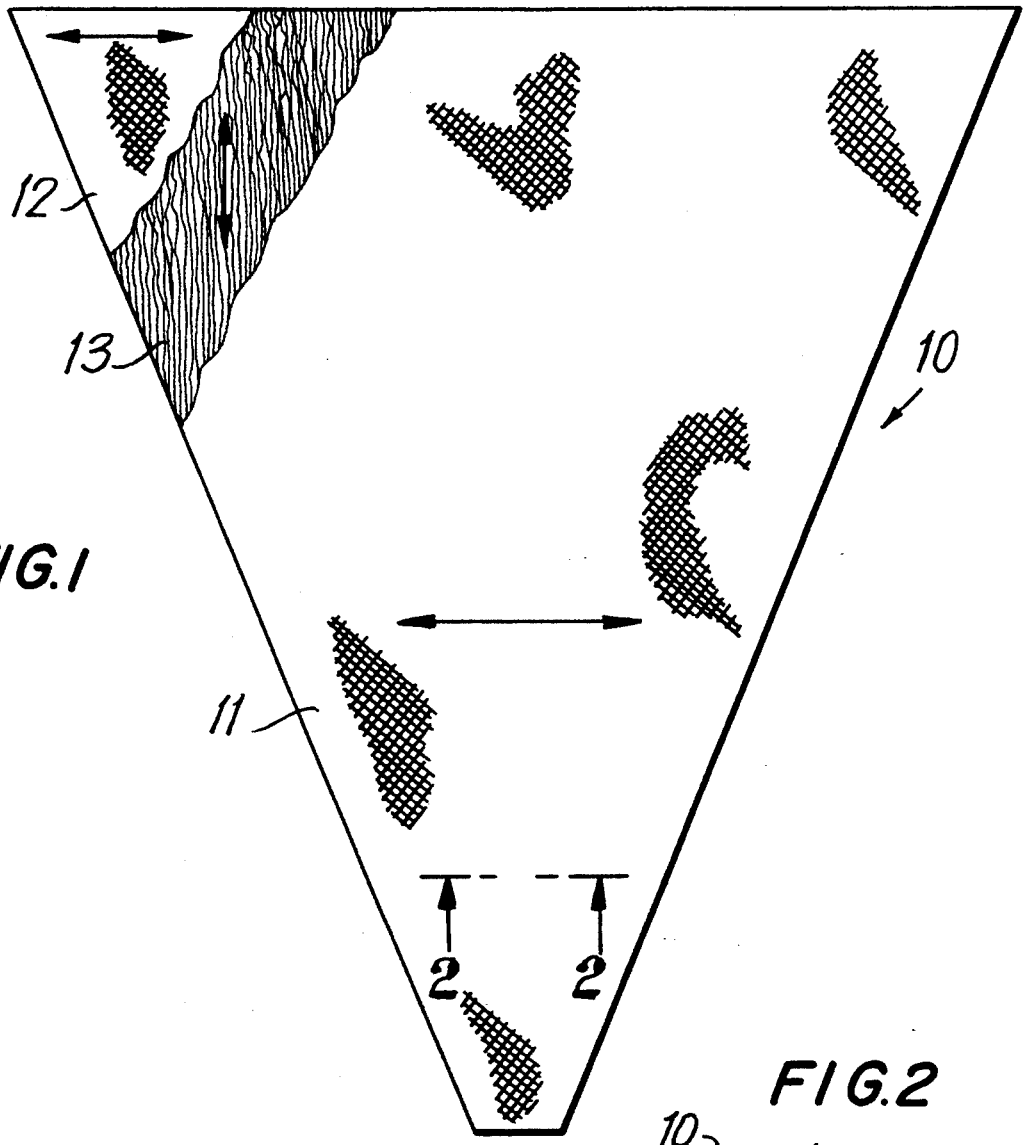
FIG.1
FIG.2
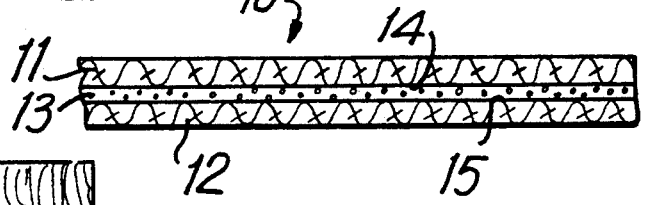
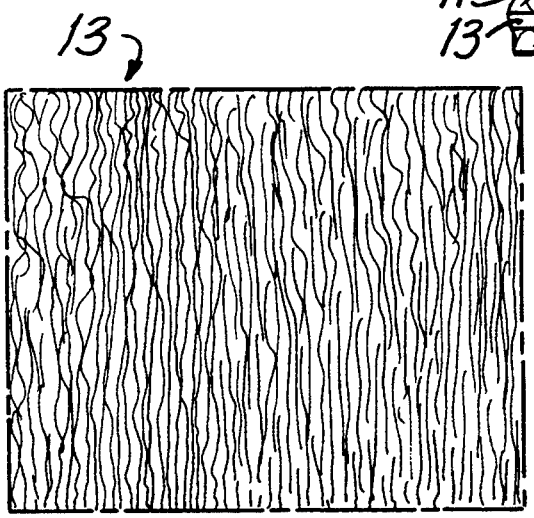
FIG.3

FABRIC LAMINATE AND GARMENTS INCORPORATING SAME

BACKGROUND OF THE INVENTION

1. Field of the Invention

The present invention relates generally to a stretch fabric laminate having particular utility in conjunction with women's undergarments, such as panties and brassieres. One or more of the fabric layers forming the laminate may preferably include elastomeric yarn. More specifically, the laminate may be located along a portion of the undergarment requiring additional support, such as the stomach panel of a panty or the undercup region of a brassiere. Such a laminate provides additional support by predeterminedly limiting the elongation of the main body fabric within the undergarment. The laminate includes the unique application of an integral adhesive web for securing the fabric layers together, with the adhesive weld being characterized as offering different magnitudes of resistance to elongation when subjected to distortion in its different directions, and being oriented within the laminate in accordance with its differential elongation characteristics.

2. Description of the Related Art

The use of laminates and other reinforcing materials to provide additional support or control at selective portions of an undergarment is generally well known. For example, Prunesti et al. U.S. Pat. No. 4,776,9116 and Bell et al. U.S. Pat. No. 4,701,964, both assigned to the assignee of the present application, disclose the utilization of a powdered adhesive material which is applied as discrete particles in a predetermined pattern and depth by a silk screen for laminating a support control panel to the main body port ion of a women's undergarment. The utilization of the silk screen for applying the powdered adhesive limits the manufacturing speed and overall efficiencies in the fabrication of such a laminate and the resultant undergarments.

The selective reinforcement of portions of a foundation garment by an intermediate plastic layer having adhesive qualities is also shown in Byrne U.S. Pat. No. 3,228,401. In that patent the plastic reinforcing material is applied to the fabric as a flowable paste which is intended to flow into the fabric and embed the individual threads forming the fabric. The plastic reinforcement may be patterned to provide reinforcement in one direction and not in the other. However, the flowing of the plastic into the fabric results in an undesired stiffening of the fabric, changing its hand or feel, and may result in irritation when applied to the skin of the wearer Galitzki et al U.S. Pat. Nos. 3,225,768 and 3,320,346 similarly show a cloth and plastic laminate for a breast support such as a bathing suit, in which the elastomeric polyethylene polymer bonds two fabrics together with the plastic flowing within the interstices of the fabric; Likewise, Storti U.S. Pat. No. 3,327,707 uses an elastomeric adhesive to secure a stomach control panel to a foundation garment with the adhesive flowing into the girdle fabric to lock itself around the individual stretch yarns.

The utilization of stiffening panels or other elements within undergarments or other apparel products is also generally shown in Flagg et al. U.S. Pat. No. 3,021,844 which shows a brassiere reinforced in the breast cup area by a stiffening liner; Penrock U.S. Pat. No. 3,750,673 which is similarly directed to a brassiere having a plurality of plastic stays positioned below the cup portion; Bracht, U.S. Pat. No. 2,915,067 wherein stiffening elements are adhesively secured to the lower cup portion of a brassiere, or waist band of a girdle; Glucken U.S. Pat. No. 4,172,002 which laminates a patch of mold able fabric as a brassiere undercup support element.

Robinson U.S. Pat. No. 4,372,321 provides a brassiere which has a unitary molded breast cup including an intermediate lower cup support panel adhesively bonded to the cup by a polyester hot melt adhesive which may typically be applied through a screen which allows dotted coverage of the surface. Such an adhesive pattern does not provide differential elongation characteristic so that the orientation of the adhesive will be a factor in controlling the overall laminate elongation characteristics. Nirenberg U.S. Pat. No. 3,317,645 discloses another method for forming a laminate or molded article such as brassiere cups with an intermediate plastic layer. Cole et al. U.S. Pat. Nos. 4,375,445 and 4,419,997, both assigned to the assignee of the present invention, are directed to molded cup brassiere in which the cup is formed of a laminate consisting of two layers of stretchable material which include a non-stretchable crown portion, a substantially non-stretchable longitudinal cup portion and a unitary multi-directional stretchable periphery portion.

Storti U.S. Pat. No. 3,383,263 is directed to a method for preparing a fabric laminate by laminating two fabrics by means of regularly recurring spaced geometric units of substantially dry adhesive film sandwiched between the outer fabric surfaces, with the result laminate having a raised pattern portion as determined by the adhesive pattern.

Adachi U.S. Pat. No. 3,497,415 forms a laminate including fabrics of different elasticity secured together with a conventional adhesive, such that the laminate characteristics are primarily determined by the elasticity of the two fabric layers. Backes U.S. Pat. No. 4,135,025 varies the stretch characteristics of a fabric by the selective insertion of different warp and weft threads into the fabric.

Additional composite elastomeric materials are disclosed in Kasper et al. U.S. Pat. No. 3,489,154 issued to the assignee of the instant application and Vander Wielen U.S. Pat. No. 4,720,415.

Accordingly, it has been observed that the prior art is replete with numerous types of laminated fabrics and, in particular, laminated stretch fabrics for undergarments wherein the layers are combined in a desired manner in order to control the overall elongation characteristics of the laminate. Typically, the prior art secures the fabric layers together using conventional adhesives which do not exhibit differential stretch characteristics. Aforementioned U.S. Pat. Nos. 4,701,964 an 4,776,916 do utilize the adhesive layer, which is applied as discrete particles of a powder through a silk screen, to play a definitive role in determining the laminate characteristics, with such characteristics being predeterminately varied by such parameters as the pattern and thickness of the particular adhesive. Similarly, aforementioned U.S. Pat. No. 3,228,401, which applies plastic reinforcing material to flow into and embed the individual yarns in the fabric can vary the support provided in different directions in accordance with the pattern of the plastic material applied as a flowable paste. Thus, while it had been recognized that the pattern of the adhesive may be a factor in controlling the laminate elongation in its various directions, the prior art necessitated application of the adhesive material through a silk screen either as a discrete particles of powder as shown in U.S. Pat. Nos. 4,701,964 and 4,776,916 or a flowable paste as in U.S. Pat. No. 3,228,401. The silk screen application of the adhesive will be a limiting factor in producing such laminates, thereby preventing optimum cost efficiencies. While garments made in accordance with aforementioned U.S. Pat. Nos. 4,701,964 and 4,776,916 have demonstrated substantial consumer acceptance and utility, it is desirable to achieve comparable results at higher manufacturing speeds, thereby resulting in lower cost for the mass production of garments typically including laminated support panels—e.g. panties and brassieres. The use of a flowable paste which is not confined to between the fabrics disadvantageously affects the fabric characteristics.

SUMMARY OF INVENTION

A fabric laminate is formed, in which both the characteristics and orientation of the adhesive layer plays a determinative role in the laminate elongation characteristics. The adhesive comprises an integral adhesive, web which has differential elongation characteristics, characterized as offering different magnitudes of resistance to elongation when subjected to distortion in its different directions. The adhesive web is confined to between the fabric layers without any appreciable penetration into the individual fabrics forming the laminate. For ease of handling, as contrasted to the screen applied hot melt adhesive or flowable plastic of the prior art, the adhesive web is formed of an integral sheet of a net-like film which may be an appropriately heat activated polyamide material. One such material, which has demonstrated particularly advantageous results is the Sharnet SH 2410 polyamide series adhesive web available from Applied Extrusion Technologies, Inc. Post Office Box 582 Middletown Del. 19709. While such a web had previously been used for securing foam to fabric and non-stretch fabrics together, as for example upholstery or the shoulder strap of a brassiere, it had not previously been appreciated that such a web has a higher degree of elongation in a first of its directions than in a second direction orthogonal to said first direction. Accordingly, the web may be preselectively orientated with respect to the primary elongation direction of the fabric layers such that the orientation of the web will contribute to the overall laminate elongation. More specifically, should both fabrics have their high elongation directions orientated generally parallel to each other, the laminate elongation will be the least when the high elongation direction of the intermediate adhesive web is orthogonally oriented with respect to the high elongation directions of the fabric layers. It should also be appreciated that other orientations of the respective higher elongation directions of the fabric layers and adhesive web may be utilized to selectively control the stretch of the resultant laminate in its various directions.

In accordance with a particularly preferred aspect of the present invention the differential elongation adhesive web is utilized to secure a control panel to a portion of a women's undergarment at a region which requires additional support. This may typically take the form of a stomach panel, thigh control panels or a rear panel of a women's panty or girdle, or the undercup support or side support panel of a brassiere. Alternatively, the additional layer may be secured to the apex portion of the brassiere cup as shown in Cole U.S. Pat. No. 4,557,267, assigned to the assignee of the instant application. One or more of the fabrics, such as the main body panel and stomach support panel of a panty, may include elastomeric yarn.

Accordingly, it is a primary object of the present invention to provide an improved fabric laminate which utilizes an integrally formed heat sensitive web adhesive film having differential elongation characteristics for securing the laminate layers.

It is another object of the present invention to provide such a laminate in which the web adhesive is selectively oriented, in accordance with its differential elongation characteristics, between a pair of non-ridged fabrics such that the resultant stretch of the laminate is combinedly determined by the elongation characteristics and orientation of the three layers forming the laminate.

Still another object of the present invention to provide an undergarment which includes such a fabric laminate.

Yet an additional object of the present invention is to provide such an undergarment which includes such a fabric laminate as a control panel.

A further object of the present invention is to provide such an undergarment having a control panel as either the stomach, thigh, or rear panel of a panty or girdle, or the undercup or side support panel of a brassiere.

It is yet another object of the invention to include such a fabric laminate in other garments such as slips, camisoles, swimming suits, body suits, leotards, tights, stretch panties or panty hose which require selectively supported portions.

These and other objects are provided by a the fabric laminate in which the web adhesive is selectively orientated with respect to the desired orientation of the control panel.

The resultant laminate, and garments including same are fabricated in a cost effective manner to provide the desired elongation characteristics and control or support in the resultant garment, as combinedly determined by the characteristics and orientation of the fabrics and intermediate adhesive web.

The foregoing and still other objects and advantages of the present invention will be more apparent upon a consideration of the following detailed explanation of preferred embodiments incorporating the present invention.

BRIEF DESCRIPTION OF THE DRAWINGS

FIG. 1 is an elevation view of the layers forming a laminate made in accordance with the present invention, prior to their heat fusing and with two of the layers broken away.

FIG. 2 is a cross-sectional view of the laminate formed of the layers shown in FIG. 1.

FIG. 3 is an elevation view of the differential stretch adhesive web used in the laminate of FIGS. 1 and 2.

Figure 4:
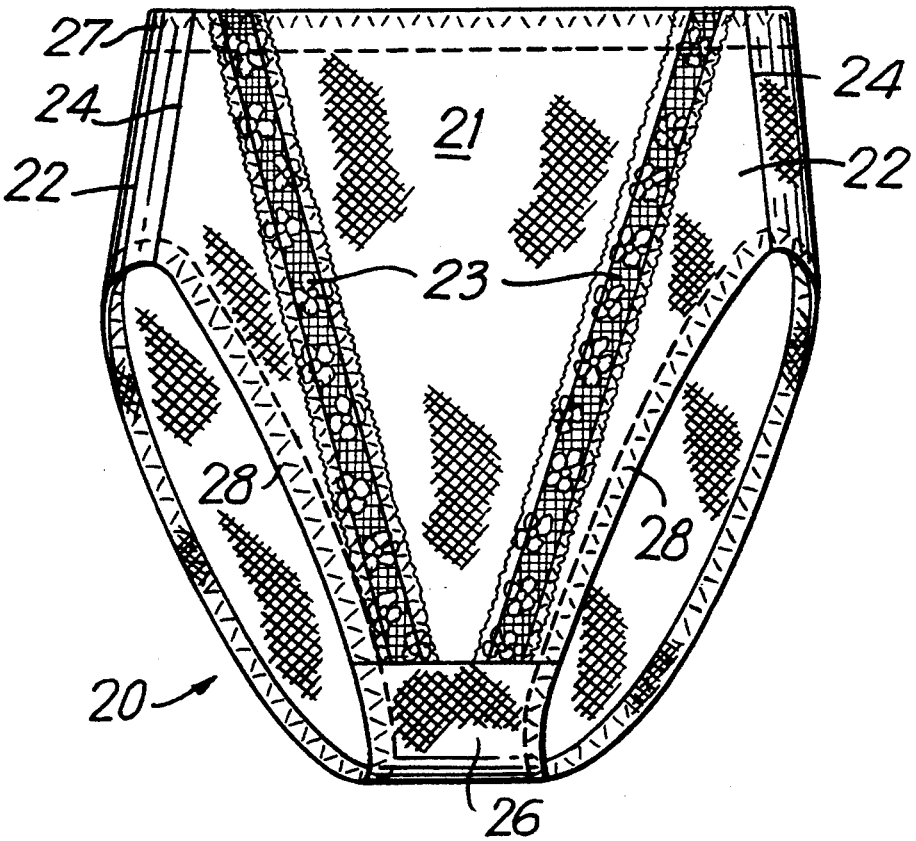
FIG. 4 is a front view of a panty in which the laminate of the present invention forms a stomach panel.

Referring initially to FIGS. 1–3*a* laminated fabric 10 is formed of fabric layers 11 and 12 which are secured to each other along their opposed surfaces 14 and 15 by the heat activated adhesive web, 13. While two fabrics are shown, additional layers may be similarly adhesively secured should three or more fabric layers (not shown) be desired. Both fabrics 11 and 12 are capable of elongation. Preferably both fabrics 11 and 12 include elastomeric yarn and hence may be considered to be elastomeric fabrics. Such fabrics are generally characterized as having rapid recovery when subjected to elongation. Their resistance to elongation, which can be controlled by the elastomeric yarn, is referred to as the modulus of the fabric. Alternatively, the fabric may not include any elastomeric yarn, and the construction of the fabric in conjunction with its placement in the garment may permit elongation, or stretch of the fabric. For example, the fabric may be knit, or, if woven the yarn placed at an angle (i.e. 45 degrees) with respect to the distorting force. This may be referred to as bias stretch which occurs from the ability of the fabric construction to distort so as to permit elongation without the use of elastomeric yarns. As is typical of such stretch fabrics, whether or not they include elastomeric yarn, they have primary elongation in one direction, as shown by the arrows of FIG. 1, with there being a lesser degree of elongation, or give, in the direction orthogonal to that shown by the arrows. The adhesive web 13, is also selected to exhibit differential elongation characteristics. That is, it offers different magnitudes of resistance to elongation when subjected to distortion in its different directions. One such web that has found specific utility in conjunction with our novel women's undergarments is aforementioned Sharnet SH 2410 which is an integrally formed net like film of a heat sensitive adhesive formed of a polyamide material. Since this web has typically previously been used to secure form to a rigid fabric, or rigid fabrics together, (with the later shown in Battreall U.S. Pat. No. 5,234,523) it had not been appreciated that such a web had differential elongation characteristics that could be a contributing factor in determining the elongation characteristics of a stretch laminate, as determined by the orientation of the adhesive web within the laminate. Thus we are employing the Sharnet web in a new combination which utilizes its previously unrecognized differential elongation characteristics. Other adhesive webs may likewise be employed, providing they do exhibit a differential elongation characteristic and their temperature characteristics are suitably coordinated with that of the fabrics employed such that they may be activated to form the laminate at a temperature which will not char or otherwise harm the fabrics 11 and 12.

When the laminate is used in a women's undergarment, such as a panty or brassiere, the fabrics 11 and 12 may typically be elastomeric fabrics knit from nylon and spandex yarns. For example, these fabrics can be knit with 40 denier 17 filament yarn with the elasticity provided by 30 denier spandex yarn. The nylon fiber content should preferably be generally in an amount between 75% and 90% and the elastomeric content in the amount between 25% and 10%. Naturally, the particular fabric employed depends on the degree of overall control required in the garment. Where only minimum control or support is sought, the nylon may be between 85% and 90% with the elastomeric material comprising about 15% to 10%. In applications were moderate control is desired, the nylon content may be between 83% and 87% and the elastomeric content between 17% and 13%. Where firm control is desired, the nylon content may be between 77% and 81% and the elastomeric content in the amount between 23% and about 19%. That is, generally the more nylon elastomeric content provided in the blend, the greater the degree of control, or higher the modulus. The fabric thickness may also be varied in accordance with techniques known in the art and discussed in aforementioned U.S. Pat. Nos. 4,701,964 and 4,776,910 to provide the desired degree of control. Fabrics 11 and 12 may, if desired, be of the same type, or may be different, again depending on the particular characteristics required in the end product.

In FIG. 1 the primary elongation direction of both fabrics 11 and 12 which form the laminate 10 are shown to be in the same direction. Laminate 10 may typically be the stomach panel shown in the panties of FIGS. 4–10. It has been determined that this placement provides optimal yield to reduce overall product cost. If desired, a further reduction in the laminate elongation characteristics can be achieved if layer 12, which forms the control panel of a women's panty is oriented 90 degrees with respect to that shown in FIG. 1. While such an alternative arrangement would provide greater support, the yield is reduced, resulting in some additional fabric waste and increased manufacturing cost. Hence, where it is desired to increase the control it is preferable to use an alternative fabric 12 for the control panel, while still retaining the orientations shown in FIG. 1, so as to provide optimum manufacturing yield.

The adhesive web is selected, as was the powdered adhesive in applicant's aforementioned U.S. Pat. Nos. 4,701,964 and 4,776,916, such that it will be substantially confined to between the opposed surfaces 14 and 15 of fabric layers 11 and 12 respectively, without flowing into either of the fabrics 11 or 12. In particular, the adhesive is not present on the outer surfaces 16 or 17 of either of fabrics 11 or 12 where it would affect the feel or hand, of the laminate.

Figure 5:
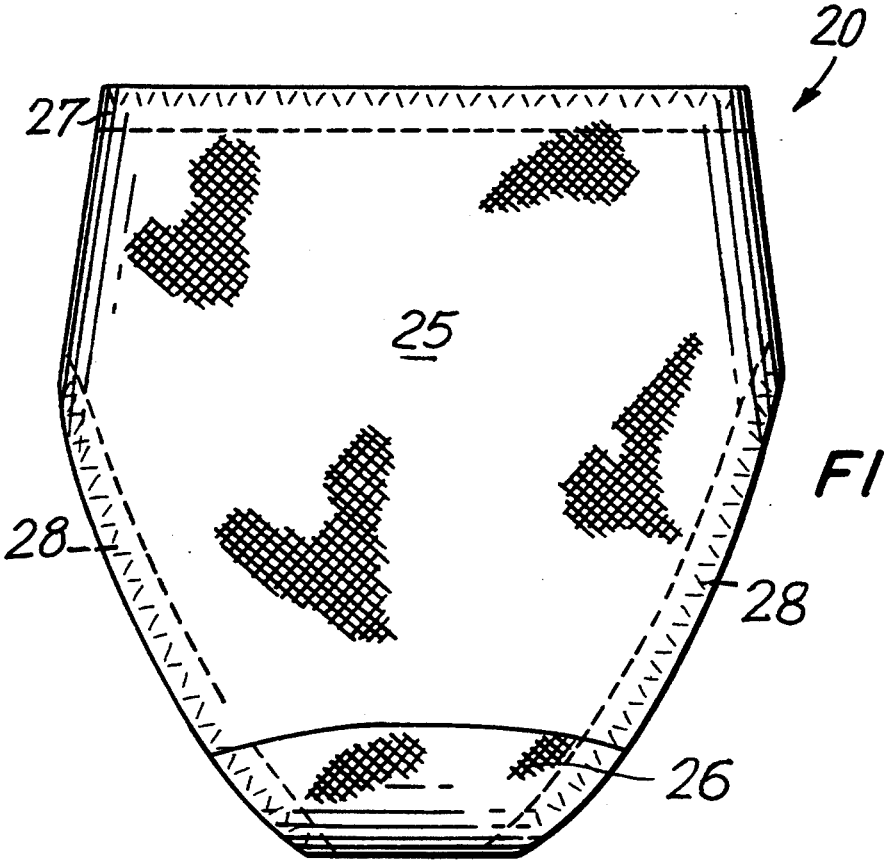
FIG. 5 is a rear view of the panty shown in FIG. 4

FIGS. 4 and 5 show the front and rear views of a typical women's panty utilizing the laminate of the instant invention for stomach control. The panty is formed of a main body fabric panel which encircles the wearer's torso. This main body panel typically includes several fabric pieces, which are sewn together. Panty 20 includes a front panel 21, frontal side panels 22 and transitional lace panels 23. Side seams 24 connect panels 23 to a rear panel 25. A crotch section 26 is typically provided at the lowermost portion of the garment. An elastic waist band 27 extends along the top of the garment. Another elastic band 28 is sewn around the edges of panels 22 to provide the frontal portion of the leg cut-out, which is continued along the sides of the crotch piece 26 and lower edge of the rear panel 25. In the particular panty shown in FIGS. 4 and 5, fabric panels 22 and 25 are a single layer formed of the same elastomeric fabric which, as heretofore discussed, may be knit of nylon and spandex yarn. The front panel 21 is formed of the laminate shown in FIGS. 1 and 2. Its outer layer corresponds to layer 11 of the laminate, and will typically be of the same fabric as panels 22 and 25, for appropriate aesthetic coordination. The laminate 21 has significantly less horizontal elongation than the panels 22 and 25. That is, the placement of the laminate at the stomach panel provides the well-known type of stomach control to flatten the wearer's stomach and hence provide figure enhancement.

The particular fabric selected for the inner fabric to form the stomach control panel 21 (corresponding to fabric 12 shown in FIGS. 1 and 2) is determined by the desired degree of control. In the panty shown in FIGS. 4 the primary elongation directions of the layers forming the stomach panel 21 may typically be horizontally oriented as shown by the arrows of FIG. 1. The main body panels 22, 25 and outer panel of laminate 21 would usually have their primary elongation direction in the horizontal direction. Should a greater degree of stomach control be desired, the innermost layer forming the control panel 21 can be turned 90 degrees so that its primary elongation will be in the vertical direction. While achieving greater control, this is apt to reduce the fabric yield and product cost. Accordingly, where increased control is required it may be preferable to achieve that result by the selection of a different fabric for the control panel, while still orienting the control panel as shown in FIG. 1, so as to retain maximum fabric yield.

Figure 6:
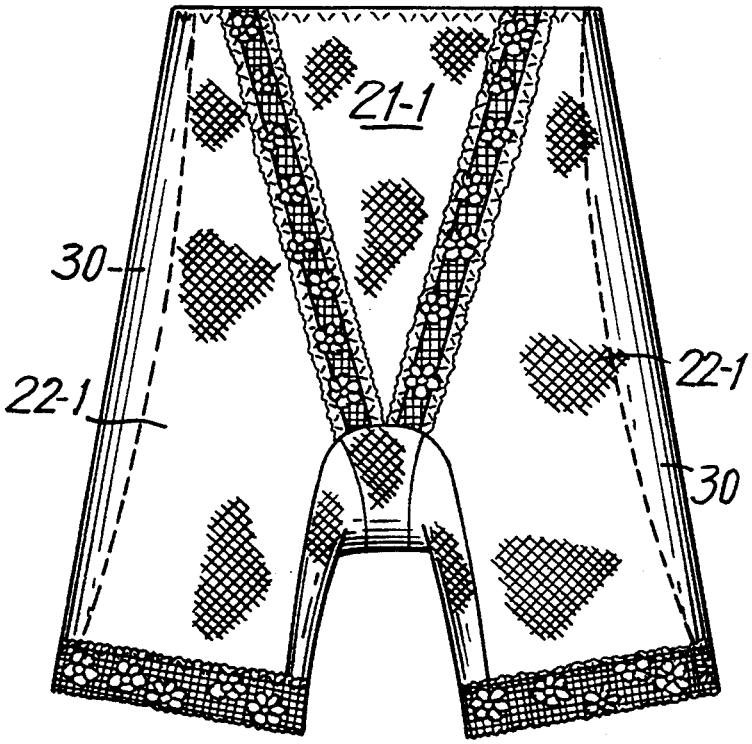
FIG. 6 is a front view of a panty similar to that shown n FIG. 4 but including a longer leg portion.
Figure 7:
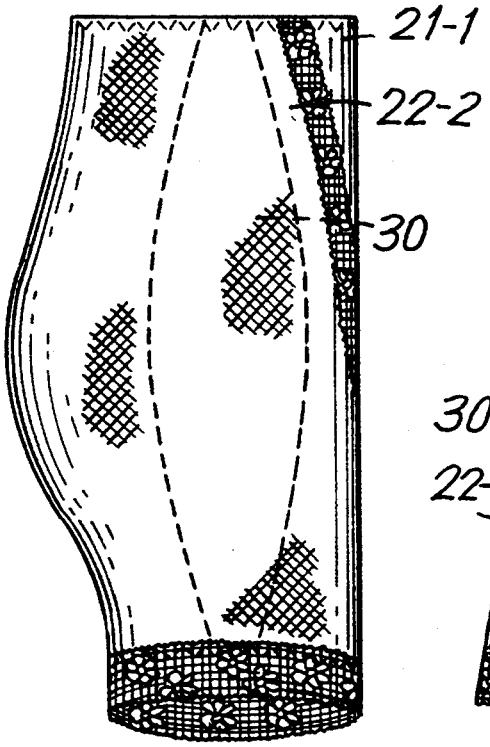
FIG. 7 is a side view of the long leg panty shown in FIG. 6, which includes a thigh control panel which is laminated to the main body panel in accordance with the present invention.
Figure 8:
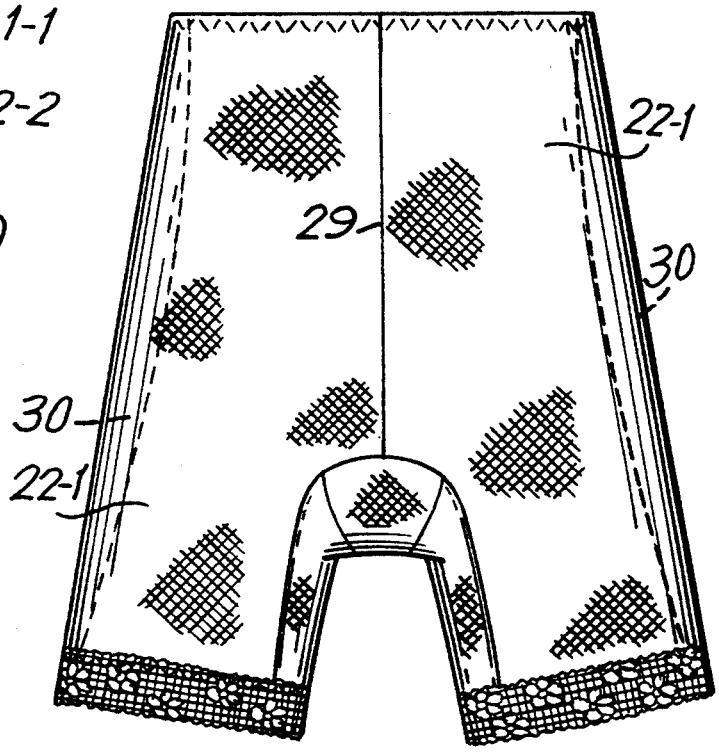
FIG. 8 is rear view of the panty shown in FIG. 6 and 7.

FIGS. 6 through 8 show the front side and rear view of modification of the panty shown in FIGS. 5 and 6. Specifically, the legs are lengthened. Instead of having a separate rear panel 25 (as shown in FIGS. 4 and 5) the side panels 22-1 are of a greater extent, meeting at the rear of the garment at vertical seam 29. Stomach panel 21-1 may generally correspond to stomach panel 21 shown in FIGS. 5 and 6. Referring to FIG. 7, the side portion of each of panels 22-1 include a thigh control support panel 30 laminated thereto. The control panel 30 is formed in accordance with the present invention, utilizing the web adhesive 13 with its primary elongation oriented in the vertical direction and a suitable inner support panel. The inner support panel forming laminate 30 may, if desired, be formed of the same fabric which is used for the inner support panel of stomach panel 21-1.

Figure 9:
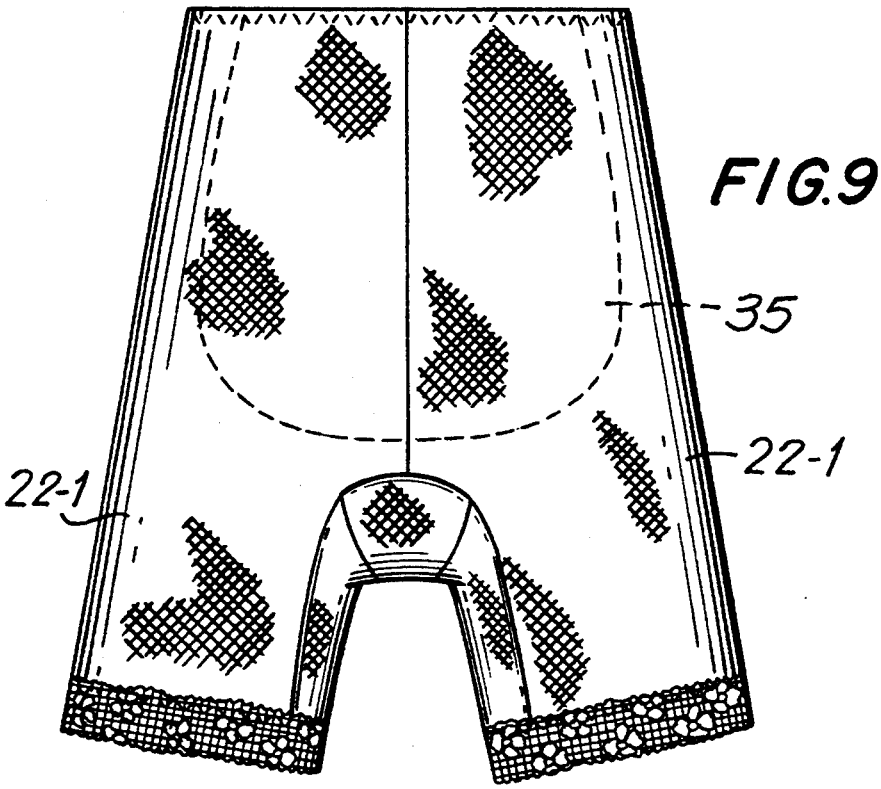
FIG. 9 is a rear view of a modification of the panty shown in FIG. 8, which includes a rear control panel in accordance with the instant invention.

FIG. 9 shown yet an additional placement of a support panel formed of the instant laminate. A rear control panel 35 is provided for a desired degree of derriere control. This garment otherwise generally corresponds to the long leg panty of FIGS. 6–8 except that the seam is deleted along the rear of the garment, by forming the side and rear paneling in the general manner of the panty in FIGS. 4 and 5, which includes a pair of side seams rather than a rear seam. If desired, the thigh control panel may be deleted in this embodiment.

Figure 10:
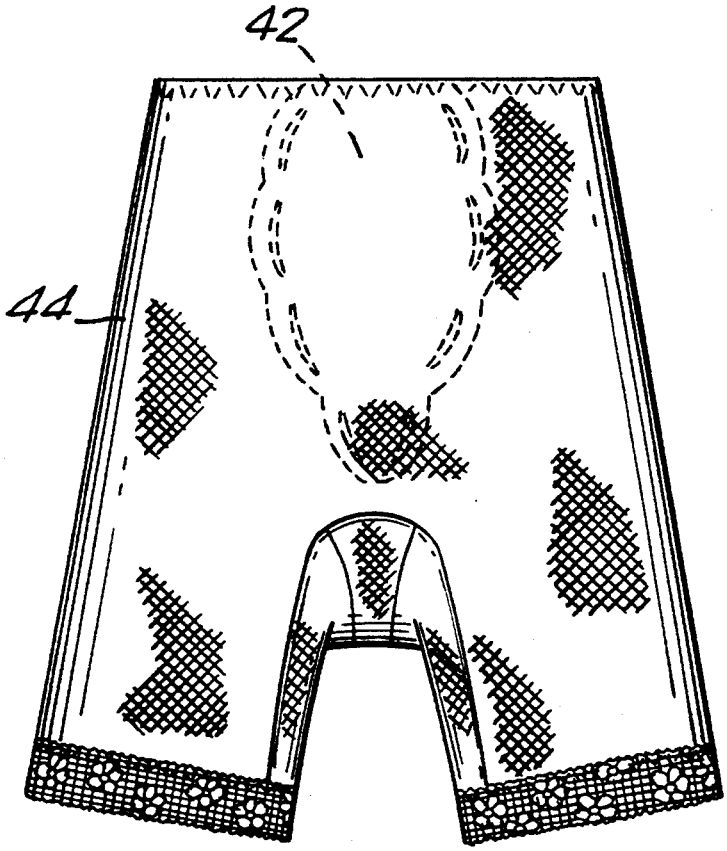
FIG. 10 is a front view of an alternative long leg panty product having a somewhat differently shaped stomach panel laminate in accordance with the instant invention.

FIG. 10 shows another long leg panty girdle following the teachings of our invention in which the stomach panel is differently configurated. Instead of being a separate laminate sewn to the other fabric portions of the garment as is illustrated in FIGS. 4 and 6. The control panel 42, which is confined to the user's stomach region, is adhesively laminated to the main body fabric 44 which forms the entire frontal portion of the garment. The shape, extent and placement of the stomach panel is predeterminedly selected in conjunction with the elongation characteristics of the main fabric body panel 44 control panel 42 and the adhesive web 13 therebetween, with the layers being appropriately oriented, to achieve the desired degree of body control and stomach support. Such panties or girdles may be suitably modified to include both rear and thigh control panels either with or without the stomach control panel formed of our laminate. That is, should the stomach control be achieved by some other construction, the laminate of the instant invention may still be utilized for thigh and/or rear body control.

Figure 11:
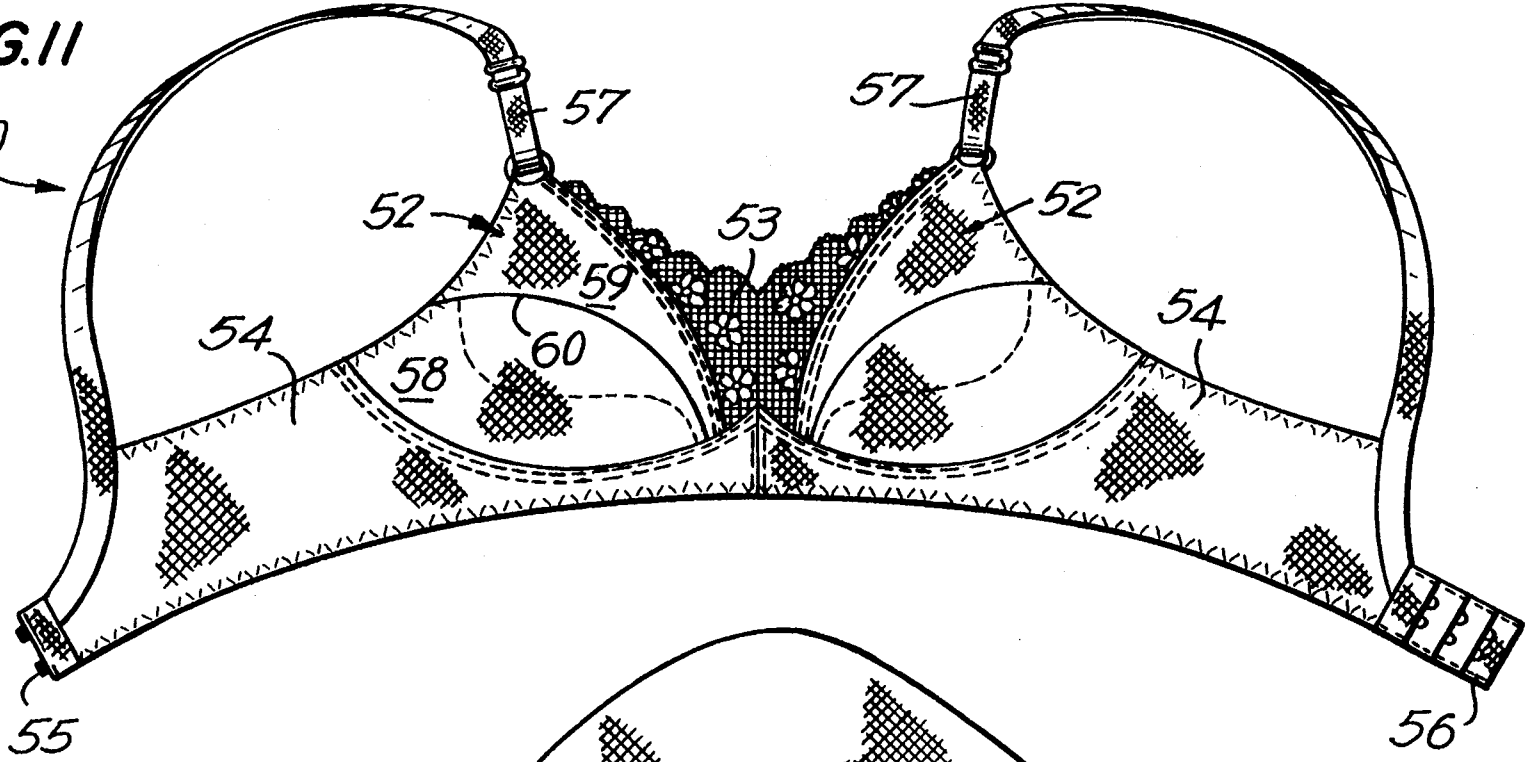
FIG. 11 is a front view of a brassiere which includes an undercup support panel in accordance with the instant invention.
Figure 12:
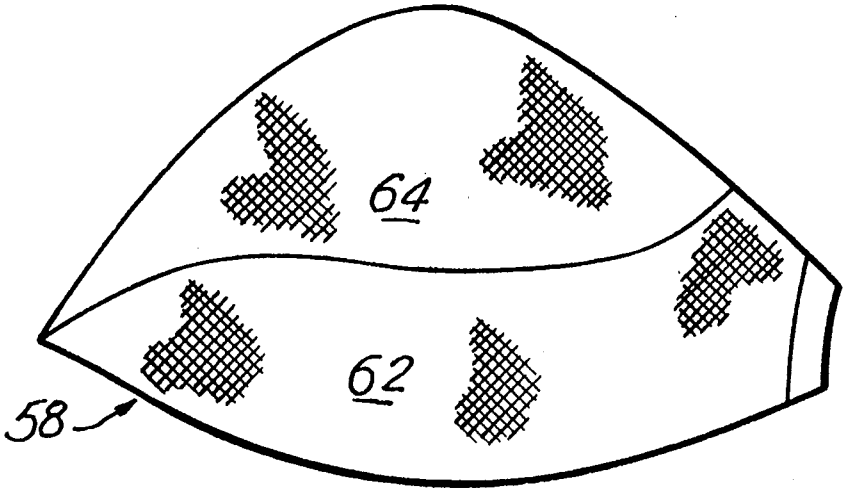
FIG. 12, is an elevational view of the lower cup section of the brassiere shown in FIG. 11.

Reference is now made to FIGS. 11 which shows a brassiere 50 which utilizes the instant laminate as an undercup support. Brassiere 50 includes a pair of cups 52 which are inwardly connected by a central platform 53. The outer sides of the cups are connected to side panels 54 which are typically connected to each other by closure means 55 and 56, which are commonly referred to as a hook and eye, and shoulder straps 57. Cups 52 shown in this particular brassiere are formed of two fabric pieces 58 and 59 which are seamed together at 60. Alternately, the cups could each be molded from a single piece of fabric, as is well known in the art. FIG. 12 shows lower section 58, which includes the instant laminate, from its inside surface prior to assembly into brassiere 50. Lower cup section 58 includes the main body panel 64 to which the support panel 62 is laminated over at least a portion of its surface. In accordance with the present invention both fabrics 62 and 64 are stretch fabrics. However, main body panel 64 would typically not include elastomeric yarn. Fabrics 62 and 64 are suitably oriented within the brassiere 50, in conjunction with the orientation of the adhesive web (such as 13) used to secure the fabrics together, so that there is a sufficient restriction of the stretch of cup 60 along the portion of undercup section 58 which includes support panel 62. This is designed to provide the desired degree of underbust support. Advantageously, fabrics 64 which forms the outer surface of cup section 58 is the same as the fabric which forms the upper cup section 59. For aesthetic purposes this may also be the same fabric used for side panels 54.

Figures 13, 14:
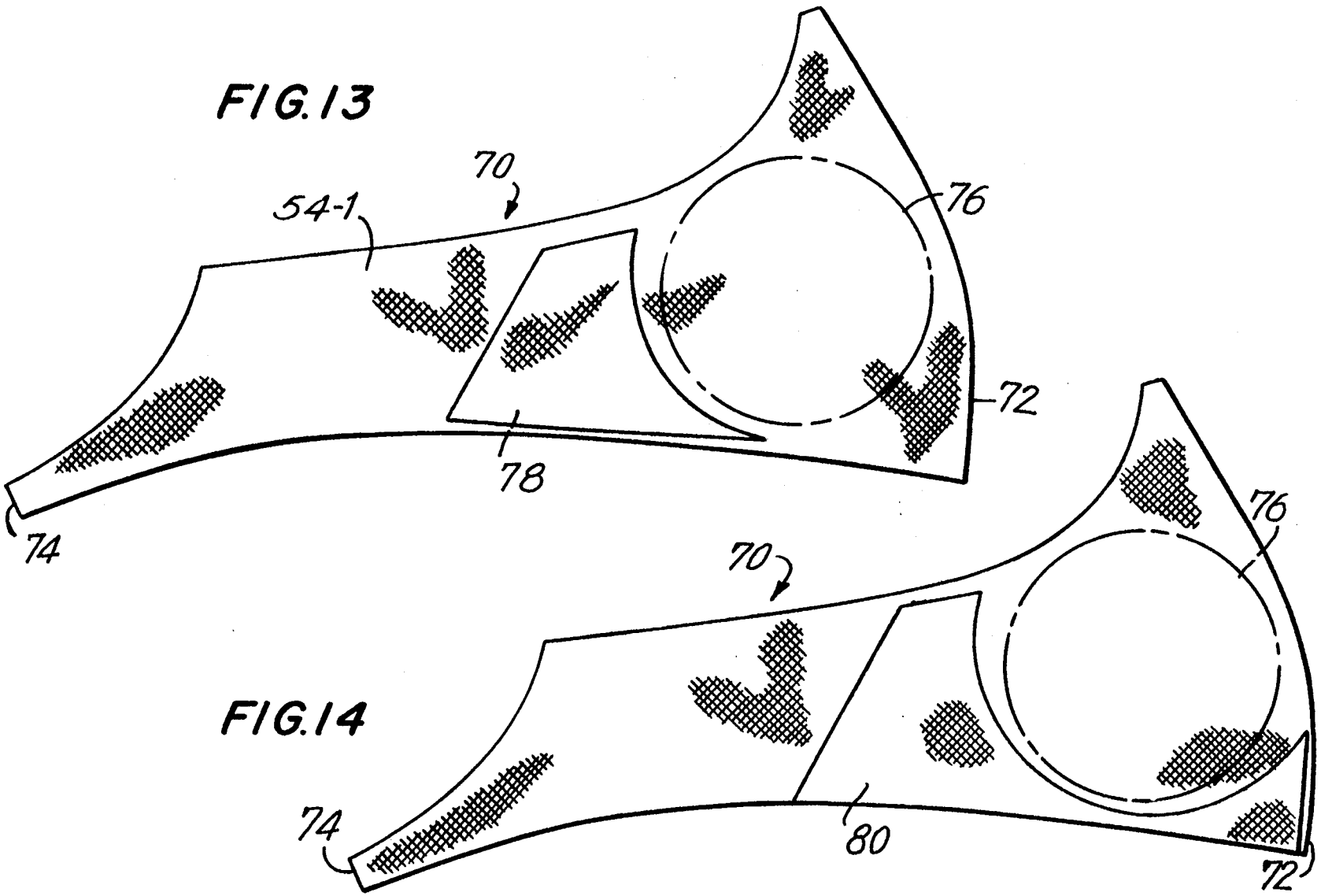
FIGS. 13 and 14 show alternative placements of the laminate support panel within a brassiere.

The teachings of the present invention may also be used for laminating a control panel applied to other locations within a brassiere. Referring to FIGS. 13 and 14 there is shown approximately one half of a brassiere frame, i.e. a side panel 70 extending from the center portion 72 to the terminus 74 where a suitable hook and eye closure (not shown) may be placed. The side panel 70 has a breast cup portion generally shown as 76 which may include an undercut support panel (not shown) of the type discussed with reference to FIGS. 11 and 12. In the brassiere portion shown in FIG. 13, a side support panel 78 is laminated to the fabric of the side panel 70. It is located adjacent to the breast cup 76 and extends towards the terminus 74, with the configuration of control panel 78 providing the desired support along the wearer's side, adjacent to her cups. Specifically, the control area 78 flattens the sides of the bust to enhance the shaping, a feature desired in brassieres, while also reducing the stretch so as to provide control in the area adjacent to the cup of the brassiere.

FIG. 14 depicts the identical portion of the side panel 70. However, the control area provided by laminate panel 80 extends under the cup and to the central platform section between the cups.

It should be understood that appropriate fabrics are selected for the support panels shown in the brassiere of embodiments of FIGS. 11–14 which are selectively oriented with respect to their elongation direction as well as the elongation direction of the fabric forming the main fabric panels and differential elongation characteristics of the adhesive web so as to provide the requisite control in the particular embodiment.

Referring now back to the formation of the laminate, two groups of individual layers 11-13, such as shown in FIGS. 1 and 2 may preferably be stacked one upon the other for manufacturing efficiencies. Naturally, the number of laminates that may be formed at one time is dependent upon the characteristics of the particular fabrics, the adhesive web and fusing press. We have found that two laminates can be simultaneously formed utilizing the aforementioned fabrics and adhesive web for undergarments. The bonding may be formed in a platen fusing press of the type generally shown in aforementioned U.S. Pat. Nos. 4,701,964 and 4,776,916. The platen and press is maintained at a temperature of between 300 Fahrenheit and about 350 Fahrenheit, preferably at a temperature between about 315 Fahrenheit and about 340 Fahrenheit. Generally, adhesive bonding of the layers is performed at a pressure between about 25 PSI and about 75 PSI and, preferably at a pressure between about 25 PSI and about 55 PSI. The fusing dwell time is typically between about 10 and 20 seconds and preferably about 12 seconds. However, the actual fusion temperature and dwell time will be determined by the specific fabrics and web adhesive selected, and number of laminates being simultaneously formed.

To demonstrate the affect that the orientation of the web adhesive has on the overall stretch characteristics of the laminate, measurements were taken of three different fabric pairs having successively greater control with a) a laminate formed with the primary stretch directions of both fabrics and the adhesive web oriented as shown in FIG. 1; b) a laminate with the fabric layers as oriented as shown in FIG. 1, but with the web rotated 90 degrees and c) the two fabric layers by themselves without any adhesive bonding. All the test samples utilized the aforementioned Sharnet SH2410 adhesive web. In sample 1 both fabric layers were formed of 22-129 nylon/spandex elastomeric material, which is composed of 85±3% nylon and 15±3% spandex. Sample 2 utilizes a different fabric for the main body panel 29-078 nylon/spandex power net which is composed of 81±3% nylon and 19±3% spandex and the same 22-129 fabric for the control panel. In the third sample, both fabrics were 22-212 nylon/spandex elastomeric material which is composed of 75±3% nylon and 25±3% spandex.

These tests were made on a Zwick Model 1425 constant rate of elongation test machine. Five tests were performed for each fabric pair. All samples were subjected to the same test conditions. Grip points were marked and the samples were clamped in the test machine at those marks. The samples were then subjected to a preset five pound load pull and the elongation measured when the machine reached the five pound load. The results are tabulated in Table 1 below,

TABLE 1

| | 1 | 2 | 3 | 4 | 5 | Average |
|---|---|---|---|---|---|---|
| SAMPLE 1 | | | | | | |
| (a) | 49.58 | 44.41 | 40.79 | 37.11 | 39.59 | 42.29 |
| (b) | 55.59 | 55.80 | 62.73 | 54.08 | 56.35 | 56.91 |
| (c) | 104.61 | 95.73 | 102.72 | 106.31 | 104.91 | 102.80 |
| SAMPLE 2 | | | | | | |
| (a) | 27.2 | 29.74 | 29.70 | 26.08 | 34.11 | 29.37 |
| (b) | 51.09 | 54.87 | 50.79 | 58.82 | 58.82 | 54.03 |
| (c) | 89.38 | 95.32 | 89.53 | 89.67 | 93.33 | 90.85 |
| SAMPLE 3 | | | | | | |
| (a) | 20.38 | 23.06 | 17.64 | 21.97 | 14.51 | 19.51 |
| (b) | 34.93 | 35.63 | 38.73 | 34.37 | 30.75 | 34.88 |
| (c) | 59.34 | 58.25 | 60.58 | 60.58 | 59.91 | 59.22 |

To ascertain the amount of reduction in elongation achieved by the adhesive web a comparison was made of the elongation laminates (a) and (b) of Table 1 with respect to the elongation of the two fabric layers which are not laminated to each other-(c) of Table 1. Table 2 below indicates the percent reduction of elongation of the laminate which was provided by the web oriented in a) the preferred direction as shown in FIG. 1 and b) a direction at right angles thereto.

TABLE 2

| Percent Reduction Provided by Adhesive Web | | | |
|---|---|---|---|
| Sample Pair | Preferred Direction | Orthogonal Direction | Difference |
| 1 | 58.55 | 45.22 | 13.63% |
| 2 | 67.67 | 40.53 | 27.14% |
| 3 | 67.44 | 41.80 | 25.64% |

Accordingly, the data indicates that the percent reduction of elongation provided by the differential stretch web adhesive differed from between about 14 to 27% when the web was turned around, thereby demonstrating the affect of the desired web orientation on the resultant laminate stretch.

Accordingly, it has been shown that the elongation characteristics of the laminate may be controlled not only by the selection of the fabrics and their orientation, but by the utilization and predetermined orientation of an adhesive web having differential elongation characteristics. While specific embodiments have been disclosed other modifications of the present invention will be obvious to those schooled in the art in the foregoing teachings. For example, the laminate may be incorporated in other garments such as swimsuits and form fitting stretch clothing utilized for skiing, bicycling or other athletic endeavors or 2) the laminate may include additional layers secured together as disclosed herein. Accordingly, while the present invention is disclosed with references to specific embodiments and particular details thereof, it is not intended that these details be construed as limiting the scope of the invention, which is defined by the following claims.

We claim:

1. A fabric laminate comprising at least a first stretch fabric, a second stretch fabric and an adhesive web;

said adhesive web positioned between opposed surfaces of said first and second stretch fabrics for adhesively securing said first and second stretch fabrics together along their opposed surfaces;

each of first and second stretch fabrics characterized as having primary elongation in one direction and lesser elongation in a second direction orthogonal to its primary stretch direction;

said adhesive web having differential elongation, characterized as offering different magnitudes of resistance to elongation when subjected to distortion in different directions, with said adhesive web having a higher degree of elongation when subjected to distortion in a first of its direction than in a second direction, orthogonal to said first direction;

said adhesive web predeterminedly oriented in accordance with its differential elongation, between said first and second stretch fabrics, with said first and second stretch fabrics disposed with respect to each other and said adhesive web such that the second direction of said adhesive web is predeterminedly oriented with respect to the first direction of at least one of the said stretch fabrics, such that the resultant elongation characteristics of the laminate is determined by the elongation characteristics of said first and second stretch fabrics in conjunction with the differential elongation characteristics of said adhesive web as determined by its predetermined orientation within the laminate.

2. The fabric laminate of claim 1, wherein said integrally formed adhesive web is an open net-like film of a heat sensitive adhesive.

3. The fabric laminate of claim 2 wherein said adhesive web is formed of a polyamide material.

4. The fabric laminate of claim 1, wherein at least one of said stretch fabrics is an elastomeric fabric which includes elastomeric yarn.

5. The fabric laminate of claim 4, wherein both said first and second stretch fabrics are elastomeric fabrics which include elastomeric yarn.

6. A fabric laminate comprising at least a first stretch fabric, a second stretch fabric and an adhesive web;

said adhesive web positioned between opposed surfaces of said first and second stretch fabrics for adhesively securing said first and second stretch fabrics together along their opposed surfaces;

said adhesive web having differential elongation, characterized as offering different magnitudes of resistance to elongation when subjected to distortion in different directions;

said adhesive web selectively orientated in accordance with its differential elongation, between said first and second stretch fabrics, such that the resultant elongation characteristics of the laminate is determined by the elongation characteristics of said first and second stretch fabrics in conjunction with the elongation characteristics of said adhesive web;

both said first and second stretch fabrics are elastomeric fabrics which include elastomeric yarn;

each of said first and second elastomeric fabrics characterized as having primary elongation in one direction and lesser elongation, or give, in a second direction orthogonal to its primary elastomeric direction;

said adhesive web having a higher degree of elongation when subjected to distortion in a first of its directions than in a second direction, orthogonal to said first direction; and the layers of said laminate formed with the primary elongation directions of said first and second elastomeric fabrics disposed with respect to each other and said adhesive web positioned therebetween wherein the second direction of said adhesive web is predeterminedly oriented with respect to the first direction of at least one of said elastomeric fabrics.

7. The fabric laminate of claim 6, wherein, the primary elongation directions of said first and second elastomeric fabrics: are generally parallel.

8. A fabric laminate of claim 6, wherein said first elastomeric fabric is a main body panel of an undergarment;

said second elastomeric fabric is a support panel, coextensive with only a portion of said first elastomeric fabric to provide additional support at a predetermined region of the undergarment;

said first and second elastomeric fabrics positioned in the undergarment with their primary elongation being in the generally horizontal direction;

said adhesive web securing said support panel to said first elastomeric fabric positioned within the undergarment with it primary elongation being in the generally vertical direction#.

9. The undergarment including the laminate of claim 8 wherein said adhesive is confined to between the opposed surfaces of the elastomeric fabrics without flowing into either fabric.

10. An undergarment including the laminate of claim 8, wherein said undergarment is a panty or girdle and said second elastomeric fabric is a stomach panel.

11. An undergarment including the laminate of claim 8, wherein said undergarment is a panty or girdle and second elastomeric fabric is a thigh control panel.

12. An undergarment including the laminate of claim 7, wherein said undergarment is a panty girdle, and second elastomeric fabric is a rear control panel.

13. An undergarment including the laminate of claim 7, wherein said undergarment is a panty girdle.

said elastomeric fabric forming a plurality of control panels at the stomach, thigh or rear.

14. An undergarment including the laminate of claim 1, wherein said undergarment is a brassiere and one of said stretch fabrics includes a portion positioned at the bottom of the cups as an underbust support panel.

15. An undergarment including the laminate of claim 1, wherein said undergarment is a brassiere and one of said stretch fabrics is positioned along each of the brassiere side panels.

16. The fabric laminate of claim 6, wherein said adhesive web is an open net-like film of a heat sensitive adhesive.

17. An undergarment including the laminate of claim 8, wherein said adhesive web is an open net-like film of a heat sensitive adhesive.

18. The undergarment of claim 17, wherein said adhesive web is formed of a polyamide material.

19. A fabric laminate of claim 6 wherein said first elastomeric fabric is a main body panel of an undergarment;

said second elastomeric fabric is a support panel coextensive with only a portion of said first elastomeric fabric to provide additional support at a predetermined region of the undergarment;

said first elastomeric fabric positioned in the undergarment with its primary elongation being in the generally horizontal direction;

the support panel of said second elastomeric fabric and adhesive web securing said support panel to said first elastomeric fabric both positioned in the undergarment with their primary elongation being in the generally vertical direction, whereby said support panel and adhesive web combinedly restrict the horizontal elongation of the undergarment at the predetermined region of their securement to the main body panel.

20. A panty comprising:

a main body panel formed of a first elastomeric stretch fabric oriented with its primary elongation disposed in a generally horizontal direction;

a stomach support panel formed of a second stretch fabric, positioned at the frontal portion of the body panel, with its primary elongation disposed in a preselected orientation;

a heat sensitive web positioned between and securing said first and second elastomeric fabrics together;

said adhesive web having differential elongation characterized by providing a higher degree of elongation when subjected to distortion in a first of its directions than in a second direction, orthogonal to said first direction, and said adhesive web predetermined oriented between said first and said second stretch fabrics with said first and second stretch fabrics orientated with respect to each other and said adhesive web such that said second direction of adhesive web differential elongation substantially corresponds to the first direction of at least one of said stretch fabrics such that the desired resistance to elongation at the stomach panel is combinedly determined by characteristics and orientation of the stretch fabric layers in conjunction with the differential elongation of said adhesive web as determined by its predetermined orientation within said stomach panel.

21. A panty comprising:

a main body panel formed of a first elastomeric fabric oriented with its primary elongation disposed in a generally horizontal direction;

a stomach support panel formed of a second elastomeric fabric, positioned at the frontal portion of the main body panel, with its primary elongation disposed in a preselected orientation;

heat sensitive adhesive web securing said first and second elastomeric fabrics together;

said adhesive web formed of a net like film having a higher degree of elongation when subjected to distortion in a first of its directions than in a second direction, orthogonal to said first direction;

said adhesive web selectively oriented between said first and said second elastomeric fabrics such that the desired resistance to elongation at the stomach panel is combinedly determined by the characteristics and orientation of the elastomeric fabric layers and said adhesive web; and the first elongation direction of said adhesive web is oriented in a generally vertical direction, orthogonal to the primary elongation direction of said main body panel.

22. The panty of claim 20, wherein said adhesive is confined to between the opposed surfaces of the elastomeric fabrics without flowing into the fabric.

23. The panty of claim 19, wherein said adhesive web is formed of a polyamide material.

24. A brassiere comprising:

a pair of cups, side support panels and a closure;

each of said cups formed a first stretch fabric oriented with its primary elongation disposed in a first preselected direction, an undercup support panel formed of a second stretch fabric, positioned along the lower region of the cup and oriented with its primary elongation disposed in a second preselected orientation;

a heat sensitive adhesive web securing said first and second fabrics together;

said adhesive web formed of a net like film having differential elongation characterized by a higher degree of elongation when subjected to distortion in a first of its directions than in a second direction, orthogonal to said first direction;

said adhesive web positioned between said first and second fabrics with its second direction substantially corresponding to the primary elongation direction of at least one of said first and second stretch fabrics, such that the desired resistance to elongation provided by said undercup support panel is combinedly determined by the characteristics and orientation of the stretch fabric layers in conjunction with the differential elongation of said adhesive web as determined by its predetermined orientation within said undercup support panel.

25. The brassiere of claim 24 wherein both said first and second stretch fabrics are elastomeric fabrics which include elastomeric yarn.

26. The brassiere of claim 25 wherein said first elastomeric fabric is oriented with its primary elongation disposed in a generally horizontal direction.

27. A brassiere comprising:

a pair of cups, side support panels and a closure;

each of said cups formed of a first stretch fabric oriented with its primary elongation disposed in a first preselected direction;

an undercup support panel formed of a second stretch fabric, positioned along the lower region of the cup and oriented with its primary elongation disposed in a second preselected orientation;

a heat sensitive adhesive web securing said first and second fabrics together;

said adhesive web formed of a net like film, which when subjected to distortion having a higher degree of elongation in a first of its directions than in a second direction, orthogonal to said first direction;

said adhesive web predeterminedly oriented between said first and said second fabrics such that the desired resistance to elongation at the undercup support is combinedly determined by the characteristics and orientation of the stretch fabric layers and adhesive web;

both said first and second stretch fabrics are elastomeric fabrics which include elastomeric yarn;

said first elastomeric fabric is oriented with its primary elongation disposed in a generally horizontal direction; and the first elongation direction of said adhesive web is oriented in a generally vertical direction, orthogonal to the primary elongation direction of said first fabric.

28. A garment including a body fabric panel, a support fabric panel and and adhesive securement between said body and support fabric panels;

said support fabric panel being of lesser area than said body fabric panel, to provide additional support to a predetermined region of said body fabric panel;

said body panel characterized as having primary elongation in a first direction and lesser elongation in a second direction orthogonal to said first direction;

said adhesive securement provided by a heat sensitive adhesive web substantially confined to between said body and support panels;

said adhesive web characterized as offering different magnitudes of resistance to elongation when subjected to distortion in its different directions and having a higher degree of elongation when subjected to distortion in a first of its directions than in a second direction, orthogonal to said first direction;

said adhesive web selectively orientated in accordance with its differential elongation, between said body and support fabric panels, with its second direction substantially corresponding to the first direction of said body fabric panel such that the desired degree of additional support is determined by the characteristics and orientation of said adhesive web within said predetermined region in conjunction with the characteristic of said body fabric and support fabric panel.

29. The garment of claim 28 wherein said body and support fabric panels are stretch fabrics.

30. The garment of claim 28 wherein at least one of said body and support panels are formed of an elastomeric fabric.

31. The garment of claim 30 wherein both said body and support panels are formed of an elastomeric fabric.

32. The garment of claim 28, wherein said adhesive web is an open net-like film formed of a polyamide material.

33. The garment of claim 28, wherein said garment is a panty, and said support fabric panel is a stomach support panel confined to the frontal portion of the panty.

34. A garment of claim 25, wherein said garment is a brassiere, including a pair of cups, and said support fabric panel comprises an underbust support panel along the bottom portion of each of said cups.

35. The method of forming a fabric laminate having at least a first stretch fabric, a second stretch fabric, each of said stretch fabrics having primary elongation in a first direction and lesser elongation in a second direction orthogonal to said first direction, and an adhesive web, comprising the steps of:

selecting a heat activated adhesive web, characterized as offering different magnitudes of resistance to elongation when subjected to distortion in different directions, positioning the adhesive web with its direction of the greatest resistance to stretch being oriented to substantially correspond to the first direction of at least one of the stretch fabrics, and positioning the web between opposed surfaces of the first and second stretch fabrics in accordance with its differential elongation, such that the resultant elongation characteristics of the laminate will be determined by the elongation characteristics and orientation of the first and second stretch fabrics in conjunction with the differential elongation and orientation of the adhesive web, and heating the laminate to a sufficient temperature to activate the adhesive web and bond the first and second stretch fabrics.

36. The method of claim 35, wherein the adhesive in the bonded laminate is substantially confined to between the opposed surfaces of the first and second stretch fabrics.

37. The method of claim 35, wherein the adhesive web is an open net-like film of a heat sensitive adhesive.

38. The method of claim 37 wherein the adhesive web is formed of a polyamide material.

39. The method of claim 35, wherein at least one of the first and second stretch fabrics is an elastomeric fabric which includes elastomeric yarn.

40. The method of claim 39 wherein both of the first and second stretch fabrics are elastomeric fabrics which include elastomeric yarn.

41. A fabric laminate comprising at least a first stretch fabric, a second stretch fabric and an adhesive web;

said adhesive web positioned between opposed surfaces of said first and second stretch fabrics for adhesively securing said first and second stretch fabrics together along with their opposed surfaces;

said adhesive web having differential elongation characterized as offering different magnitudes of resistance when subjected to distortion in different directions;

said adhesive web selectively oriented in accordance with its differential elongation between said first and second stretch fabrics, such that the resultant elongation characteristics of the laminate is determined by the elongation characteristics of said first and second stretch fabrics in conjunction with the elongation characteristics of said adhesive web;

each of said first and second stretch fabrics characterized as having primary elongation in one direction and lesser elongation, or give, in a second direction orthogonal to its primary elongation direction;

said adhesive web having a higher degree of elongation when subjected to distortion in a first of its directions than in a second direction, orthogonal to said first direction;

at least one of said first and second stretch fabrics is an elastomeric fabric which include elastomeric yarn; and the layers of said laminate formed with the primary elongation directions of said first and second fabrics disposed with respect to each other and said adhesive web positioned therebetween wherein the second direction of said adhesive web is predeterminedly oriented with respect to the second direction of at least one of said fabrics.

42. A fabric laminate comprising at least a first stretch fabric, a second stretch fabric and an adhesive web;

said adhesive web positioned between opposed surfaces of said first and second stretch fabrics for adhesively securing said first and second fabrics together along their opposed surfaces;

each of first and second stretch fabrics characterized as having primary elongation in one direction and lesser elongation in a second direction orthogonal to its primary stretch direction;

said adhesive web having differential elongation, characterized as offering different magnitudes of resistance to elongation when subject to distortion in different directions, with said adhesive web having a higher degree of elongation when subjected to distortion in a first of its directions than in a second direction, orthogonal to said first direction;

said adhesive web predeterminedly oriented in accordance with its differential elongation, between said first and second stretch fabrics, with said first and second stretch fabrics disposed with respect to each other and said adhesive web such that the second direction of said adhesive web is predeterminedly oriented with respect to the second direction of at least one of the said stretch fabrics, such that the resultant elongation characteristics of the laminate is determined by the elongation characteristics of said first and second stretch fabrics in conjunction with the differential elongation characteristics of said adhesive web as determined by its predetermined orientation within the laminate.

* * * * *